United States Patent [19]

Kuk

[11] 4,133,080

[45] Jan. 9, 1979

[54] TEXTBOOK HOLDER

[76] Inventor: John Kuk, 1419 Calle Durazno, Thousand Oaks, Calif. 91306

[21] Appl. No.: 520,724

[22] Filed: Nov. 4, 1974

[51] Int. Cl.[2] ..... A45F 5/12

[52] U.S. Cl. ..... 24/73 HH; 24/81 AG

[58] Field of Search ..... 24/81 AG, 265 A, 265 C, 24/17 R, 884 H, 73 A, 73 HH, 265 H, 265 BH, 265 C, 265 A, 265 R, 265 EC, 265 BC; 38/140; 224/45 N, 50, 55, 58

[56] References Cited

U.S. PATENT DOCUMENTS

| | | | |
|---|---|---|---|
| 1,420,027 | 6/1922 | Ehrman et al. | 38/140 X |
| 1,881,653 | 10/1932 | Kastner | 24/265 A |
| 3,128,520 | 4/1964 | Carter et al. | 24/265 H |
| 3,283,433 | 11/1966 | Navarino | 24/73 A |

*Primary Examiner*—Werner H. Schroeder
*Attorney, Agent, or Firm*—Jack C. Munro

[57] ABSTRACT

A device to hold text books tightly against a notebook wherein a stretchable strap is connected at opposite ends to a clasp, each said clasp to operate over the edge of the notebook, the strap to be stretched permitting insertion of one or more text books between the strap and the notebook to thereby secure the text book(s) to the notebook.

1 Claim, 5 Drawing Figures

TEXTBOOK HOLDER

BACKGROUND OF THE INVENTION

The field of this invention relates to stationery devices and more particularly to a book holder which is to be employed in combination with a conventional loose-leaf notebook.

Almost all students employ the use of a loose-leaf notebook. A loose-leaf notebook is a binder which facilitates insertion and removal of sheets of paper. The normal procedure is for each student to carry the notebook in one hand with the edge of the notebook resting against the person's side. Any text books which are being carried are placed on top of the notebook and clamped between the person's forearm and the surface of the notebook.

It is not at all uncommon for the textbooks to slide free of the notebook and fall to the ground or floor. In actual practice, the text books easily slide free of the notebook and it is most annoying to have to pick up the text books and place them again on the notebook before the person can continue on his way.

There is definitely a need for a device which will securely bind a text book to the notebook as the person is moving from one locale to another. The device should also be capable of securely binding either a single text book, small or large, or a plurality of different text books.

SUMMARY OF THE INVENTION

The structure of this invention is believed to be summarily described in the Abstract Of The Disclosure and reference is to be had thereto.

The primary objective of the structure of this invention is to employ a device which is readily attachable to a conventional notebook and facilitates insertion and removal of a text book or text books to bind such to the notebook during the time the text book is not in use and the person is moving from one classroom to another classroom.

A further objective of this invention is that the structure is simply designed and readily facilitates attachment to a notebook.

A still further advantage of this invention is that the device is of simple construction and can be readily manufactured at a low manufacturing cost.

DETAILED DESCRIPTION OF THE SHOWN EMBODIMENT

Figure 1:
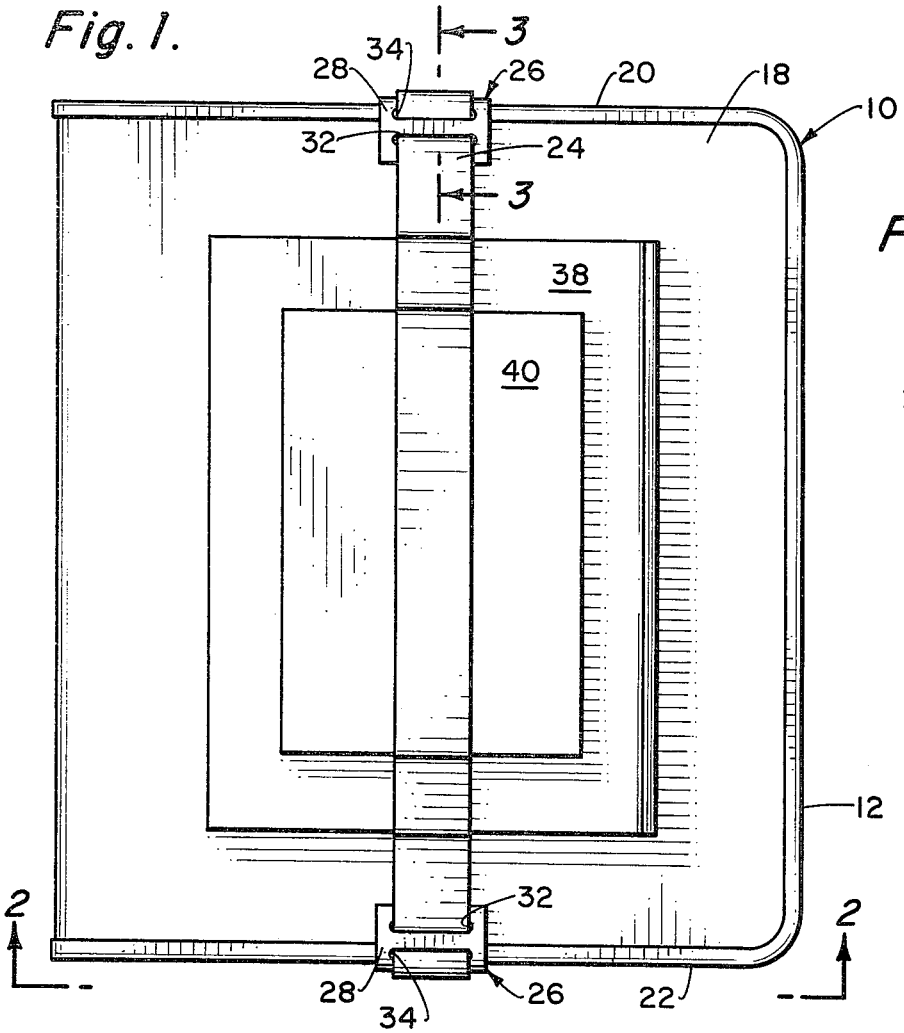
FIG. 1 is a plan view of a notebook to which has been attached the structure of this invention with the structure being shown binding two text books to the notebook.
Figure 3:
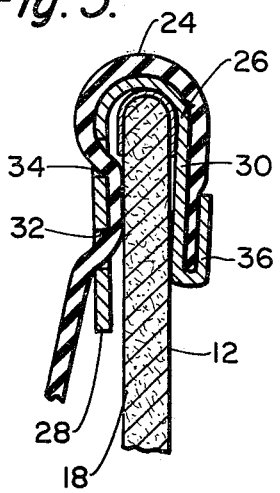
FIG. 3 is a cross-sectional view through one of the clasps of the device of this invention taken along line 3—3 of FIG. 1.
Figure 2:
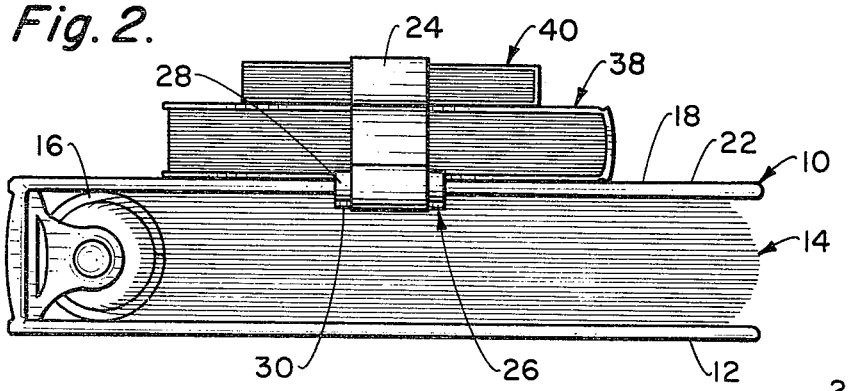
FIG. 2 is an end view of the structure of FIG. 1 taken along line 2—2 of FIG. 1.
Figure 4:
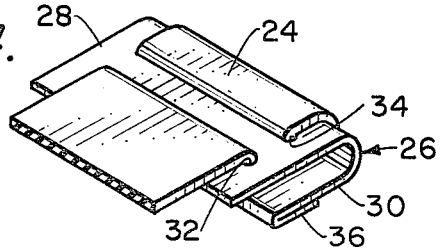
FIG. 4 is a top side isometric view of the clasp portion of the device of this invention.
Figure 5:
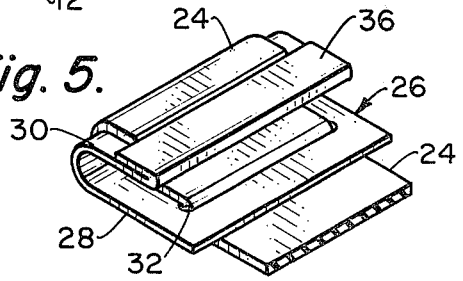
FIG. 5 is a bottom side isometric view of the clasp portion of the device of this invention.

Referring particularly to the drawing there is shown in FIG. 1 a conventional notebook 10 being formed generally of a binder 12 with leaves of paper 14 to be placed between sections of the binder 12. The papers 14 are retained in position by means of binding rings 16 which are openable and closeable in a conventional manner in order to facilitate the locating between the sections of the binder 12 the leaves 14 of paper. It is to be understood that the notebook 10 is openable to permit access into the leaves 14 of paper and also closeable as shown in FIGS. 1 and 2. The left section of the binder 12 is to include a top surface 18 and an upper edge 20 and a lower edge 22.

The structure of this invention generally comprises a stretchable strap 24 which terminates at each end in a clasp 26. The clasps 26 are identical in construction and it is to be understood that there are to be two in number employed for each strap 24. The length of the strap 24 is selected so that when in position it is normally at rest against the top surface 18. The preferred material of construction of the strap 24 will be rubber, however, it is considered to be within the scope of this invention that other materials could be employed.

Each clasp 26 is basically U-shaped in construction and is formed into a first leg 28 and a second leg 30. Included within the first leg 28 is a first longitudinal opening 32 and a second longitudinal opening 34. The leg 30 includes a section 36 which is folded over upon itself.

One end of the stretchable strap 24 is conducted inwardly through the opening 32 and then out through opening 34 around the apex of the clasp 26 and then terminates in the space between leg 30 and section 36. Section 36 is forced toward leg 30 so as to tightly compress the stretchable strap 24 located therebetween thereby securing the stretchable strap 24 to the clasp 26.

It is to be understood that the other end of the stretchable strap 24 is similarly secured to the other clasp 26.

With each clasp 26 overlying its particular edge 20 or 22 of the notebook 10, the portion of the stretchable strap 24 extending between the openings 32 and 34 is in tight contact with the top surface 18 of the notebook 10. A slight amount of additional frictional holding force is provided tending to maintain the attached position of each clasp 26 with the notebook.

The operation of the device of this invention is believed to be readily apparent and merely requires one clasp 26 to be placed over edge 20 and the other clasp 26 placed over the edge 22 with the stretchable strap 24 located therebetween. In this position, the stretchable strap 24 will be positioned in a slightly stretched state and located tightly against the top surface 18. When a person desires to carry one or more text books, such as text books 38 and 40, the person grabs the strap 24 and pulls such out from the top surface 18. The person then places the books 38 and 40 upon the top surface 18 beneath the stretchable strap 24. The person then releases the strap 24 permitting such to tightly press against the text book 40 which causes both text books 38 and 40, in this instance, to be tightly held upon the notebook 10.

What is claimed is:

1. In combination with the notebook, said notebook having a hard cover binder, said notebook having a peripheral edge, said notebook being adapted to retain a plurality of leaves of papers, a holding device for securely retaining at least one textbook upon said notebook, said holding device comprising:

a first clasp and a second clasp with a stretchable strap located therebetween, said first clasp to be in engagement with one edge of the periphery of said notebook with said second clasp being in engagement with an opposite edge of the periphery of said notebook causing said stretchable strap to be just slightly stretched therebetween, whereby said stretchable strap can be manually stretched to a displaced position above the top surface of said notebook permitting location of at least one textbook between said top surface and said stretchable strap and when released, said stretchable strap tightly presses the textbook against the top surface of said notebook;

each said clasp being U-shaped in configuration, each said clasp including a section bent over on its self one end of said stretchable strap being tightly compressed by bent over section thereby affecting securing of said stretchable strap to said clasp, and each said clasp including a pair of spaced apart openings, said strap being conducted through said openings prior to coming into contact with said bent over section, the portion of said strap between said openings to be in contact with the top surface of said notebook.

* * * * *